US008393929B2

(12) United States Patent
Laiche

(10) Patent No.: US 8,393,929 B2
(45) Date of Patent: Mar. 12, 2013

(54) BOATING SAFETY LIFELINE

(76) Inventor: Shane Laiche, Road Gonzales, LA (US)

( * ) Notice: Subject to any disclaimer, the term of this patent is extended or adjusted under 35 U.S.C. 154(b) by 284 days.

(21) Appl. No.: 12/772,355

(22) Filed: May 3, 2010

(65) Prior Publication Data

US 2011/0269356 A1 Nov. 3, 2011

(51) Int. Cl.
*B63C 9/26* (2006.01)

(52) U.S. Cl. ..... 441/84

(58) Field of Classification Search ..... 441/84, 441/85, 88, 80
See application file for complete search history.

(56) References Cited

U.S. PATENT DOCUMENTS 165,122 A * 6/1875 Reynolds ..... 24/599.5
3,664,457 A * 5/1972 York ..... 182/70
4,973,277 A * 11/1990 Khanamirian ..... 441/88
2008/0254693 A1 * 10/2008 Zogg ..... 441/84

* cited by examiner

*Primary Examiner* — Edwin Swinehart
(74) *Attorney, Agent, or Firm* — Jerry Haynes; Law Office of Jerry D. Haynes, P.A.

(57) ABSTRACT

The present invention relates to a mountable safety device for a boat comprising: a canister where said canister includes as mounting lip at one end and an opening at the opposite end; a lifeline assembly, where said assembly includes a stored position and a released position, where the lifeline is stored within the canister; and a mechanism to release the lifeline assembly from the canister. The canister includes a releasable door that seals the opening and provides the mechanism to release the lifeline assembly. An eyelet is provided near the opening and provides a mechanism to attach the lifeline assembly onto the canister. The lifeline assembly includes an attachment end and a clasp end, where the attachment end attaches to the eyelet and the clasp end includes a mechanism to attach a floatation device.

5 Claims, 2 Drawing Sheets

BOATING SAFETY LIFELINE

BACKGROUND OF THE INVENTION

1. Field of Invention

The present invention relates to a safety lifeline used for boating purposes in emergency situations.

2. Description of Related Art

Boating is recreational activity enjoyed by millions of people on a yearly basis. Recreational boats come in various sizes and categories such as the small kayak or paddleboat and larger boats such as cruisers, sailboats or yachts. Many individuals enjoy recreational boating, however one critical aspect of boating is safety in case of emergency accident. Some of the safety devices used by boaters include life jackets, floatation devices, distress signals, and satellite location devices. In the situation where a wreck has occurred or a boat has capsized, the occupants may be tossed into the nearby waters and are subject to rough currents or any dangerous marine life such as sharks. Although a floatation device such as a life jacket may assist the individual to remain afloat, many times a floatation device alone isn't sufficient due to the shock of the accident, weather conditions and/or physical limitations especially where an individual may be lost at sea for a period of time. Further, it is more difficult to locate an individual who is separated from his boat as opposed to locating individuals that are near or at least in close proximity to the damaged or cap sized boat. Many times a capsized boat will remain afloat and provide an object for the victims to hold on to until help arrives. Although it may be feasible to maintain a grip or mount oneself on a capsized boat it would be a difficult task over a period of time due to the water conditions or inclimate weather. It would therefore be advantageous to have a lifeline that may be allow an individual to attach the capsized boat until help arrives.

SUMMARY OF THE INVENTION

The present invention relates to a mountable safety device for a boat comprising: a canister where said canister includes as mounting lip at one end and an opening at the opposite end; a lifeline assembly, where said assembly includes a stored position and a released position, where the lifeline is stored within the canister; and a means to release the lifeline assembly from the canister. The canister includes a releasable door that seals the opening and provides the means to release the lifeline assembly. An eyelet is provided near the opening and provides a means to attach the lifeline assembly onto the canister. The lifeline assembly includes an attachment end and a clasp end, where the attachment end attaches to the eyelet and the clasp end includes a means to attach a floatation device.

DETAILED DESCRIPTION

The present invention relates to a canister that is mountable on the hull of a boat. The canister includes a lifeline that is releasable in case of emergency. The canister according to present invention provides a means to attach a lifejacket to the lifeline contained within the canister. Once the accident victim is attached to this lifeline he or she remains attached to the boat and increases the likelihood of survival over a long period of time.

Figure 1:
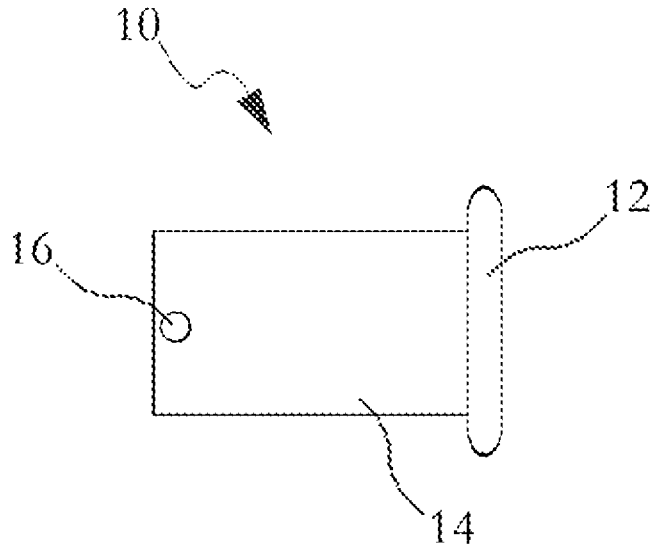
FIG. 1 depicts a mountable cable canister according to present invention.

FIG. 1 depicts a side view of a lifeline canister according to the present invention. The lifeline canister includes a mounting lip 12 and a body portion 14. At one end of the canister 10, a mounting eyelet 16 is provided. The mounting eyelet 16 connects one end of a lifeline as contained within the canister 14. The mounting lip 12 provides a lip that provides a means to mount the canister to the outer hull of the boat.

Figure 3A:
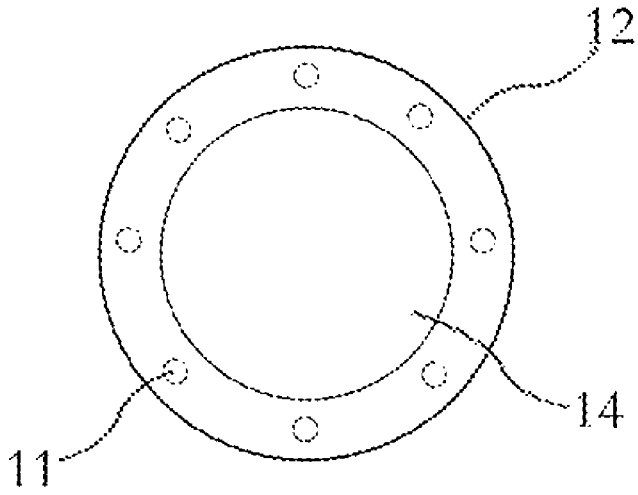
FIG. 3A depicts a front view of the canister according to the present invention.

A front view of the canister 14 is provided in FIG. 3A. As shown, the mounting lip 12 includes a plurality of holes around the perimeter. The holes are used to insert bolts that mount the canister 14 directly to the hull of the boat. The canister 14 is hollow and provides a means for the insertion of a lifeline in the form of a cable.

Figure 2:
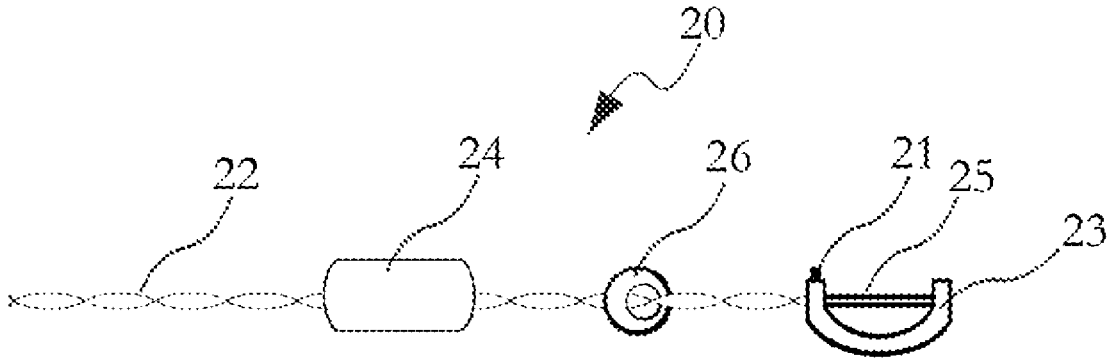
FIG. 2 depicts a lifeline that may be contained within the canister according to the present invention.

FIG. 2 depicts the lifeline 20 according to the present invention. The lifeline 20 includes a cable 22 that has a means for attachment to the eyelet 16 of the canister 14. At the opposite end of the cable 22 is a metal clasp 23. The metal clasp 23 includes a spring-loaded button 21 and a closure bar 25. The metal clasp 23 provides the means for the user to attach their lifejacket to the lifeline 20. Other components of the lifeline 20 include a buoy 24 and an eye 26. These items are placed between the metal clasp 23 and the attachment end of the cable 22.

Figure 3B:
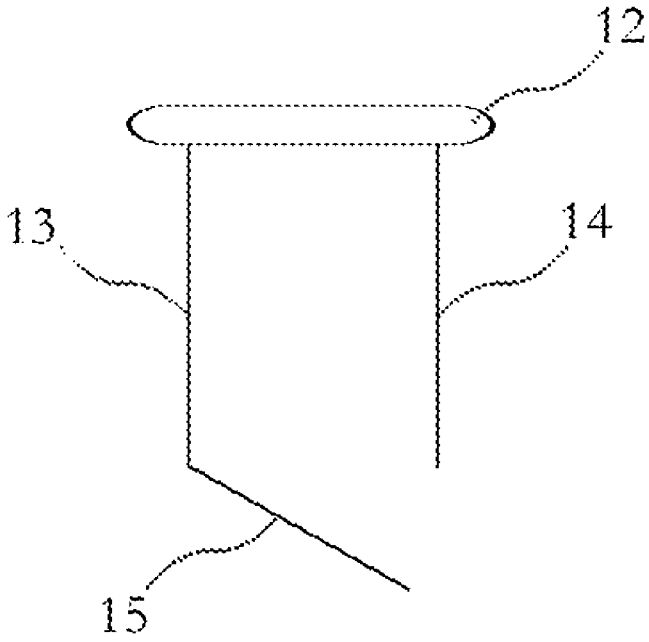
FIG. 3B depicts the top view of the canister according to the present invention.

The lifeline 20 is compressed into the canister 14 and may be released for use in case of emergency. FIG. 3B shows a door 15 that is attached to the open end of the canister 14. The small door 15 is released by the user to allow the lifeline 20 to be released from the canister 14. The release of the lifeline 20 allows the user to attach their life jacket to the metal clasp 23 and provides a way for the victim to remain close and attach to the capsized or wrecked boat.

The lifeline 20 assists the victim in remaining afloat near the wreckage site even during the most terrible weather conditions. The lifeline provides a practical and necessary safety device that assists in the boating emergencies particularly since many of these emergencies occurred during terrible weather conditions. The components of the lifeline fit inside the canister and through the release of the cover or door allows the release of a lifeline and therefore availability to use by the victim. Further, the canister is easily mounted to the hull of the boat through a use of the bolts through the plurality of holes along the mounting lip.

What is claimed is:

1. A mountable safety device for a boat comprising:

a. a canister where said canister includes as mounting lip at one end and an opening at the opposite end and said mounting lip extends around the perimeter of the canister, where the mounting lip includes a plurality of holes;

b. a lifeline assembly, where said lifeline assembly is a cable compressed within the canister capable of a stored position and a released position;

c. a buoy fastened to the lifeline, where the buoy enables the lifeline to float; and d. a releasable door that seals the opening, where the releasable door enables the release of the lifeline assembly from the canister.

2. The mountable safety device according to claim 1, where an eyelet is provided near the opening, where said eyelet provides a means to attach the lifeline assembly onto the canister.

3. The mountable safety device according to claim 2, where the lifeline assembly includes an attachment end and a clasp end, where the attachment end attaches to the eyelet and the clasp end includes a means to attach a floatation device.

4. The mountable safety device according to claim 3, where the clasp end includes a metal clasp, said metal clasp includes a spring-loaded button and a closure bar.

5. A mountable safety device for a boat comprising:

a. a canister where said canister includes as mounting lip at one end and an opening at the opposite end;

b. a lifeline assembly compressed within the canister, where said assembly includes:

i. a stored position and a released position, ii. an attachment end and a clasp end, where the attachment end attaches to the eyelet and the clasp end includes a means to attach a floatation device; and iii. a buoy to enable the lifeline to float;

c. an eyelet provided near the opening, where the eyelet provides a means to attach the lifeline assembly to the canister; and d. a releasable door that seals the opening, where the releasable door enables the release of the lifeline assembly from the canister.

* * * * *